US011020310B2

(12) United States Patent
Cross

(10) Patent No.: US 11,020,310 B2
(45) Date of Patent: Jun. 1, 2021

(54) BODY MASSAGING DEVICE

(71) Applicant: THE ARMAID COMPANY, INC., Blue Hill, ME (US)

(72) Inventor: Terry Cross, Blue Hill, ME (US)

(73) Assignee: The Armaid Company, Inc., Blue Hill, ME (US)

( * ) Notice: Subject to any disclaimer, the term of this patent is extended or adjusted under 35 U.S.C. 154(b) by 245 days.

(21) Appl. No.: 16/351,465

(22) Filed: Mar. 12, 2019

(65) Prior Publication Data

US 2019/0274915 A1 Sep. 12, 2019

Related U.S. Application Data

(60) Provisional application No. 62/804,765, filed on Feb. 13, 2019, provisional application No. 62/641,428, filed on Mar. 12, 2018.

(51) Int. Cl.
*A61H 15/00* (2006.01)

(52) U.S. Cl.
CPC . *A61H 15/0092* (2013.01); *A61H 2015/0042* (2013.01); *A61H 2201/1635* (2013.01)

(58) Field of Classification Search
CPC ..... A61H 15/0092; A61H 2201/1635; A61H 2015/0042; A61H 2015/0021; A61H 2015/005; A61H 2201/0153; A61H 2201/1614; A61H 2205/062;
(Continued)

(56) References Cited

U.S. PATENT DOCUMENTS 1,400,547 A * 12/1921 Holmstrom ..... A61H 15/0092 601/125
2,219,138 A * 10/1940 Morrison ..... A61H 15/0078 601/125

(Continued)

OTHER PUBLICATIONS

Tillum, Maura, "The Only Self-Massage Tool You'll Ever Need?" https://www.linkedin.com/pulse/only-self-massage-tool-youll-ever-need-maura-tillum/, Apr. 27, 2016, 2 pages, Linkedln.

(Continued)

*Primary Examiner* — Garrett K Atkinson
(74) *Attorney, Agent, or Firm* — Socal IP Law Group LLP; Jonathan Pearce

(57) ABSTRACT

A self-operated apparatus particularly adapted for massaging a user's wrist and forearm affected by repetitive strain injuries such as carpal tunnel syndrome comprises two clamping arms hingedly joined at one end and provided with cooperating handles at the other ends. Rollers and balls are mounted on opposite median sections of the arms. The hinged ends of the arms are universally attached to a support that can be strapped over the user's thigh, whereby an arm can be adjustably clamped between the sets of rollers and balls by bringing the two handles together and the arm and wrist massaged by translating and rotating movements of the arm along an axis perpendicular to the mounting axes of the rollers and balls. Either of the arms may include a latching mechanism operable between an open position and a closed position. When in the open position, the massaging member is removable from the arm and may be replaced by a different massaging apparatus.

19 Claims, 11 Drawing Sheets

(58) Field of Classification Search
CPC ..... A61H 2205/06; A61H 2205/12; A61H 2201/0157; A61H 2201/1253; A61H 15/00
See application file for complete search history.

(56) References Cited

U.S. PATENT DOCUMENTS 3,465,750 A * 9/1969 Schawalder ..... A63B 21/04 601/122
3,583,396 A * 6/1971 Landis ..... A61H 15/0092 601/125
3,759,250 A * 9/1973 Salata ..... A61H 15/00 601/122
3,814,085 A * 6/1974 Kupchinski ..... A61H 15/0092 601/122
4,191,177 A * 3/1980 Abbott ..... A61H 1/00 601/125
5,643,182 A * 7/1997 Engel ..... A61H 15/0092 601/119
5,730,708 A * 3/1998 Spratt ..... A61H 7/003 601/118
5,735,803 A * 4/1998 Musilli ..... A61H 15/0092 601/128
D395,088 S * 6/1998 Wiggs, Sr. ..... D24/211
5,792,081 A * 8/1998 Cross ..... A61H 15/0092 601/123
5,885,232 A * 3/1999 Guitay ..... A61H 7/008 601/6
6,010,468 A * 1/2000 Grove ..... A61H 1/0266 601/23
6,013,010 A * 1/2000 Farsaie ..... A63B 21/0004 482/118
6,436,062 B1 * 8/2002 Iwamoto ..... A61H 15/00 601/122
6,494,851 B1 * 12/2002 Becher ..... A61H 7/001 601/101
6,517,499 B1 * 2/2003 Pereira ..... A61H 7/008 601/125
6,607,499 B1 * 8/2003 Becher ..... A61H 7/007 601/101
6,974,427 B1 * 12/2005 Lapham ..... A61H 15/00 601/120
7,399,287 B2 * 7/2008 Meisch ..... A61H 7/005 601/136
D688,380 S * 8/2013 Nelson ..... D24/211
9,066,844 B2 * 6/2015 Thiebaut ..... A61H 15/02
9,125,791 B2 * 9/2015 Collins ..... A61H 15/00
9,561,152 B2 * 2/2017 Johnston ..... A61H 7/002
9,616,267 B2 * 4/2017 Sassano ..... A61H 1/0292
9,622,937 B2 * 4/2017 Nelson ..... A01K 13/00
D802,155 S * 11/2017 Cross ..... D24/211
D802,782 S * 11/2017 Cross ..... D24/211
10,004,658 B2 * 6/2018 Marty ..... A45D 34/04
D844,802 S * 4/2019 Reyes ..... D24/215
10,278,889 B2 * 5/2019 Olschansky ..... A61H 15/0092
2002/0165073 A1 * 11/2002 Tsai ..... A61H 15/0092 482/148
2004/0254508 A1 * 12/2004 Lee ..... A61H 7/003 601/119
2007/0093734 A1 * 4/2007 Chen ..... A61H 7/004 601/99
2007/0173750 A1 * 7/2007 Hudock ..... A61H 15/00 601/128
2008/0086066 A1 * 4/2008 Munday ..... A61H 39/04 601/135
2009/0149785 A1 * 6/2009 Canto Garcia ..... A61H 7/007 601/99
2010/0185128 A1 * 7/2010 Galvez Campos .. A61H 1/0288 601/135
2011/0137218 A1 * 6/2011 Collins ..... A61H 15/00 601/118
2013/0109546 A1 * 5/2013 Huang ..... A61H 7/003 482/115
2013/0289454 A1 * 10/2013 Wang ..... A61H 15/00 601/132
2014/0039363 A1 * 2/2014 Johnston ..... A61H 7/002 601/135
2014/0228723 A1 * 8/2014 Cockerill ..... A61H 15/0092 601/128
2015/0173999 A1 * 6/2015 Vanderstegen-Drake ..... A61H 9/0092 601/151
2015/0231014 A1 * 8/2015 Capobianco ..... A61H 7/007 601/135
2016/0193107 A1 * 7/2016 Johnston ..... A61H 15/0092 601/128
2016/0213555 A1 * 7/2016 Johnston ..... A61H 7/003
2016/0310351 A1 * 10/2016 Nelson ..... A61H 15/00
2017/0231862 A1 * 8/2017 Olschansky ..... A61H 15/0092 601/128
2019/0142689 A1 * 5/2019 Marty ..... A45D 40/26 601/112
2019/0231636 A1 * 8/2019 Olschansky ..... A61H 15/0092
2020/0368101 A1 * 11/2020 Nash ..... A61H 15/00

OTHER PUBLICATIONS

Osborn, Jennifer, "Blue Hill man's massage device wins praise from climbing community," The Ellsworth American, Mar. 5, 2015, 2 pages, The Ellsworth American.

The Armaid Company, Inc., "The Armaid Company, Inc. Rubbit, Rub Your Whole Body," https://www.amazon.com/rubbit-rub-your-whole-body/dp/B01DCHA9EO/ref=cm_cr_arp_d_product_top?ie=UTF8, Mar. 31, 2021, 5 pages, Amazon.com.

* cited by examiner 104
102e
102a
102d1
102d4
103
126a
102d2
102c
102d
120
102d5
102d3
114
121
112
106

BODY MASSAGING DEVICE

CROSS REFERENCE TO RELATED APPLICATIONS

This application claims priority to a provisional application, U.S. Ser. No. 62/641,428, filed Mar. 12, 2018, entitled Body Massaging Device, by Terry Cross, which is hereby incorporated by reference. This application further claims priority to a provisional application, U.S. Ser. No. 62/804,765, filed Feb. 13, 2019, entitled Body Massaging Device, by Terry Cross, which is hereby incorporated by reference.

FIELD

The present disclosure relates to self-operated body massaging devices and more particularly to devices adapted for the treatment of an individual limbs, such as legs and arms as well as other muscles and tendons in the body.

BACKGROUND

In the field of physical therapy self-operated body massaging devices have been known to be adapted for the treatment of wrists and arms affected by carpal tunnel syndrome, tendonitis and repetitive strain and overuse injuries and for the treatment of muscular anomalies of the elbows, thighs, calves, feet, neck, fingers, and shoulders.

However, most self-operated massaging devices are handheld massagers that do not provide for any stabilizing support and therefore cannot apply any substantial amount of controllable therapeutic pressure on the ailing muscle or tendon. Other automatic massaging devices driven by electric motors are not capable of reacting to a sudden pain felt by the user, and, therefore can inflict a great deal of unnecessary suffering before the user can turn off the device as the massaging heads reach a particular sensitive spot. Other manual massage devices are set at specific points and do not have the capability for the user to adjust pressure in real time immediacy.

There is therefore a need for a simple and inexpensive, yet effective self-operated (or hand-operated) body massaging apparatus which can be firmly stabilized and applied under the user's own motions without risk of inflicting undue pain or discomfort and offers unlimited control of all vectors, angles and pressure in order for the user to be in constant and immediate control for the user to change any variables easily.

SUMMARY

The following presents a simplified summary of one or more implementations in order to provide a basic understanding of some implementations. This summary is not an extensive overview of all contemplated implementations, and is intended to neither identify key or critical elements of all implementations nor delineate the scope of any or all implementations. Its sole purpose is to present some concepts of one or more implementations in a simplified form as a prelude to the more detailed description that is presented later.

According to one feature, a body massaging apparatus is provided. The message apparatus includes a first arm, having a first arm upper end and a first arm lower end, the first arm lower end having a pair of elongated members extending outward therefrom and separated by a channel, each of the elongated members in the pair of elongated members having a slotted guideway; a second arm having a second arm upper end and a second arm lower end, the second arm lower end having a securing member adapted to be received in a pair of depressions formed in the slotted guideway of the each of the elongated members in the pair of elongated members, where the second arm is rotatable in relation to the first arm; a first massaging member secured within a medial section of the first arm; a second massaging member secured within a medial section of the second arm; and a latching mechanism having a rotatable member with a cavity and a tab extending outwardly from the rotatable member, the latching member operable between an open position and a closed position; wherein when in the open position, a shaft of the second massaging member is removable from the second arm.

According to an aspect, the body massaging apparatus further comprises a first handle integrally connected to, and extending perpendicularly outward from, the first arm upper end; and a second handle integrally connected to, and extending perpendicularly outward from, the second arm upper end.

According to another aspect, the body massaging apparatus further comprising an extension handle adapted for securing to the first and/or second longitudinal handles.

According to yet another aspect, wherein the extension handle comprises: an elongated member; a body member, the body member integrally connected to the elongated member; a longitudinal first leg extending perpendicularly outward from the body member; a longitudinal second leg extending perpendicularly outward from the body member, the longitudinal first leg is parallel to the longitudinal second leg; and wherein each of the of the longitudinal first and second legs comprises a plurality of openings adapted to fit over the first and/or second handles.

According to yet another aspect, wherein the slotted guideway includes a lower surface, having a plurality of depressions, and an upper surface where the upper and lower surfaces are separated by a distance.

According to yet another aspect, wherein the distance is adapted to receive the securing member.

According to yet another aspect, wherein the securing member is hollow.

According to yet another aspect, wherein the slotted guideway a last opening in the slotted gateway is oval shaped and larger than the remaining openings in the slotted gateway.

According to yet another aspect, wherein the oval shaped opening allows the second arm to be rotated downward and slid out of the slotted gateway.

According to yet another aspect, the body massaging apparatus further comprises a stopper adapted to be received into the hollow securing member for securing the second arm in the body massaging apparatus.

According to yet another aspect, wherein the second arm comprises: an outer surface; an inner surface having separated by and integrally connected to an inner wall, the inner surface having a second massaging member cavity adapted to receive the second massaging member.

According to yet another aspect, wherein the outer surface has a continuous arcuate shape; and wherein the inner surface includes an upper portion, a medial portion and a lower portion where the medial portion is integrally connected between the upper portion and the lower portion.

According to yet another aspect, wherein the medial portion is connected to the upper portion by the latching mechanism.

According to yet another aspect, wherein the second massaging member includes an elongated shaft extending through the second massaging apparatus, the shaft having an upper end and an opposing lower end.

According to yet another aspect, wherein the lower end of the shaft is adapted to be received in a shaft opening located in a lower portion of the second arm.

According to yet another aspect, wherein the upper end of the shaft is adapted to be received in the cavity of the latching mechanism.

According to yet another aspect, wherein the tab on the latching mechanism is rotated covering the cavity and locking the upper end of the shaft in the latching mechanism.

According to yet another aspect, wherein the tab extends outwardly from the latching mechanism.

According to yet another aspect, wherein rotating the tab to expose the cavity allows the second massaging member to be replaced with a different massaging member.

BRIEF DESCRIPTION OF THE DRAWINGS

The features, nature, and advantages of the present aspects may become more apparent from the detailed description set forth below when taken in conjunction with the drawings in which like reference characters identify correspondingly throughout.

DETAILED DESCRIPTION

In the following description, specific details are given to provide a thorough understanding of the embodiments. However, it will be understood by one of ordinary skill in the art that the embodiments may be practiced without these specific details.

Overview

Embodiments of the present disclosure are directed to a body massaging apparatus. The body massager apparatus is a hand-operated, body-massaging apparatus for the preventive or remedial treatment of muscular disorders and more specifically for the treatment of muscles and tendons in the wrists, arms, legs as well as other parts of the body. The apparatus is in the form of a simple, yet efficient device that allows for stable and easily controllable application of rolling pressure to the affected area.

These and other valuable objects are achieved by a self-operated apparatus body massaging apparatus comprising two arms (for example clamping arms) joined about a base, which can be placed on any surface and positioned to any desired orientation. The arms are adjustable relative to each other, providing for use with varying sized body parts. Support and/or massage members installed in a face-to-face arrangement in medial sections of the arms can be brought to work against body parts while the free upper ends of the arms are held together with the free hand of a user. The apparatus may be adapted for massaging body parts of a user affected by repetitive strain injuries, including but not limited to tendinitis and carpal tunnel syndrome. Flexible massaging members may be mounted on or secured within opposite medial sections of the arms. One or more of the arms may include a latching mechanism operable between an open position and a closed position. When in the open position, the user can remove the massaging member and when in the closed position, the massaging member is secured in place.

A body part may be placed between the two arms of the device to be acted upon by the massaging members, whereby the body part is adjustably clamped between the pair of massaging members and massaged by translating and rotating movements of the body part along an axis perpendicular to the mounting axes of the massaging members.

Alternatively, the free upper ends of the arms may be held in close proximity to each other, for example by the free hand of the user. The apparatus may compress the body part from opposite sides to enhance blood and lymph circulation through muscle tissue. An extension handle may be utilized in connection with a handle of one of the arms to allow the arms to create a larger opening while still allowing user to hold the handles of both arms together with one hand.

Body Massaging Apparatus

Figure 1:
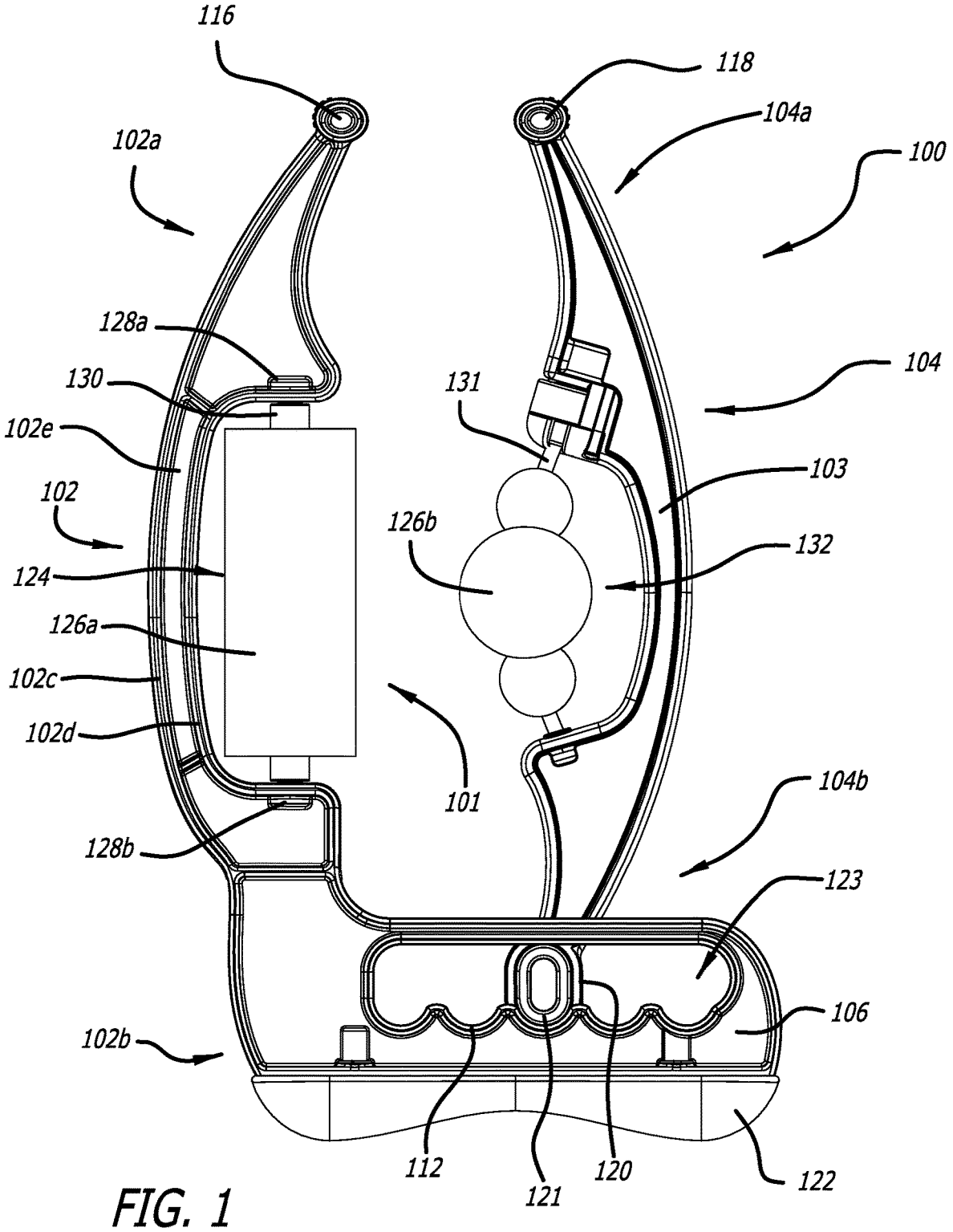
FIG. 1 is a first side view of a massaging apparatus.
Figure 2:
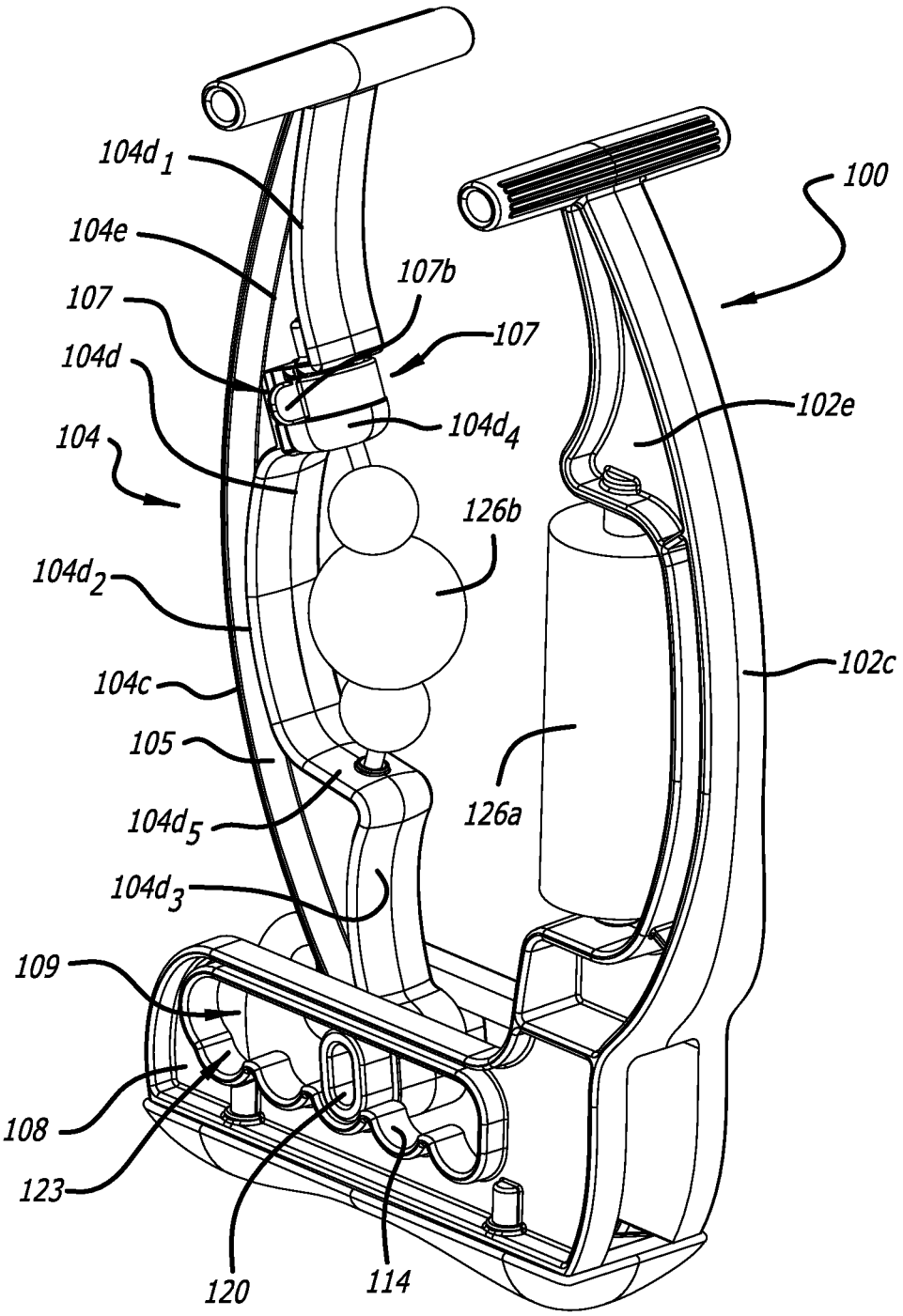
FIG. 2 is back left side perspective view of the body massaging apparatus of FIG. 1.
Figure 3:
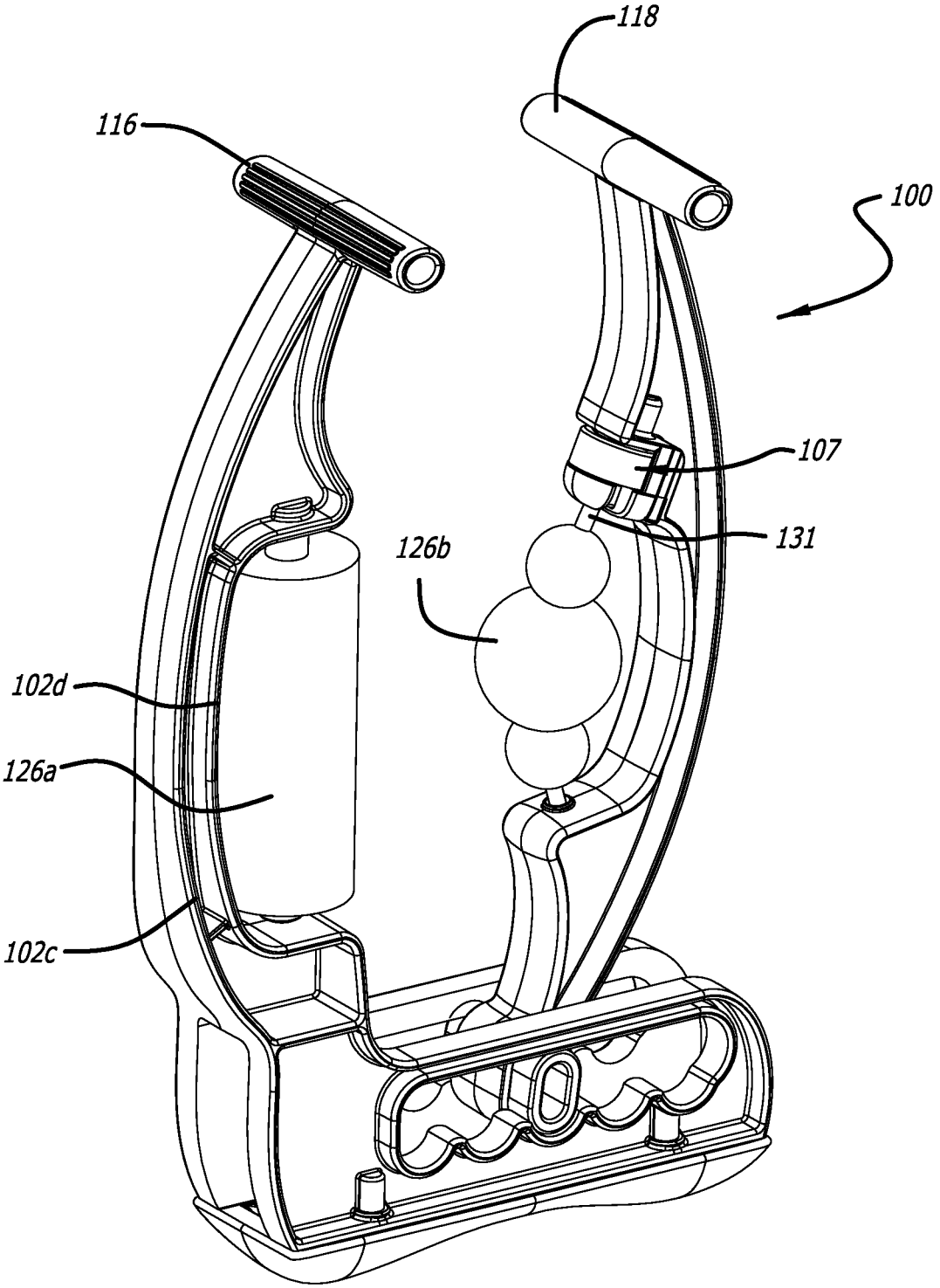
FIG. 3 is back right side perspective view of the body massaging apparatus of FIG. 1.
Figure 4:
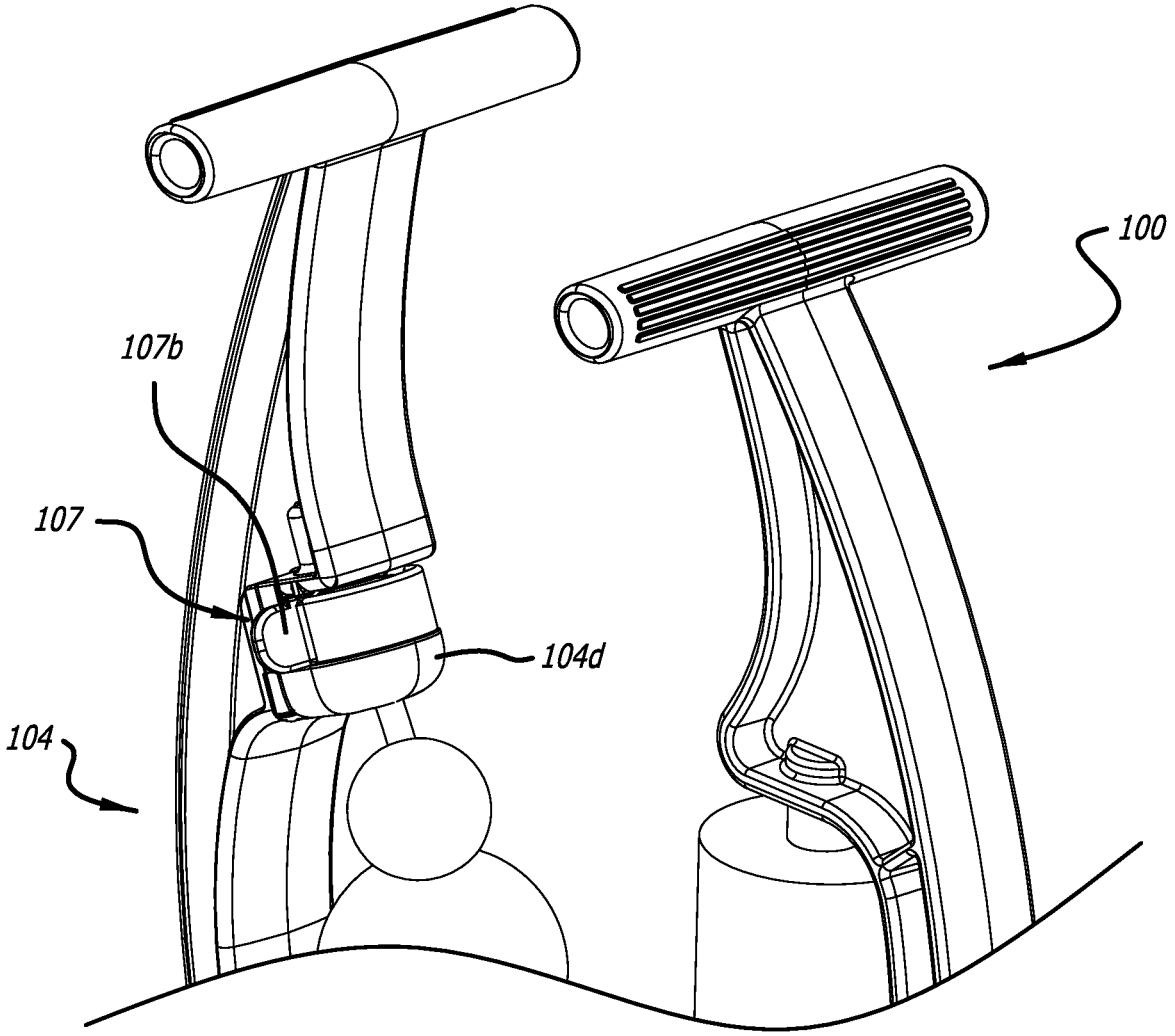
FIG. 4 is a partial close up view of first and second arms of the body massaging apparatus of FIG. 1.
Figure 5:
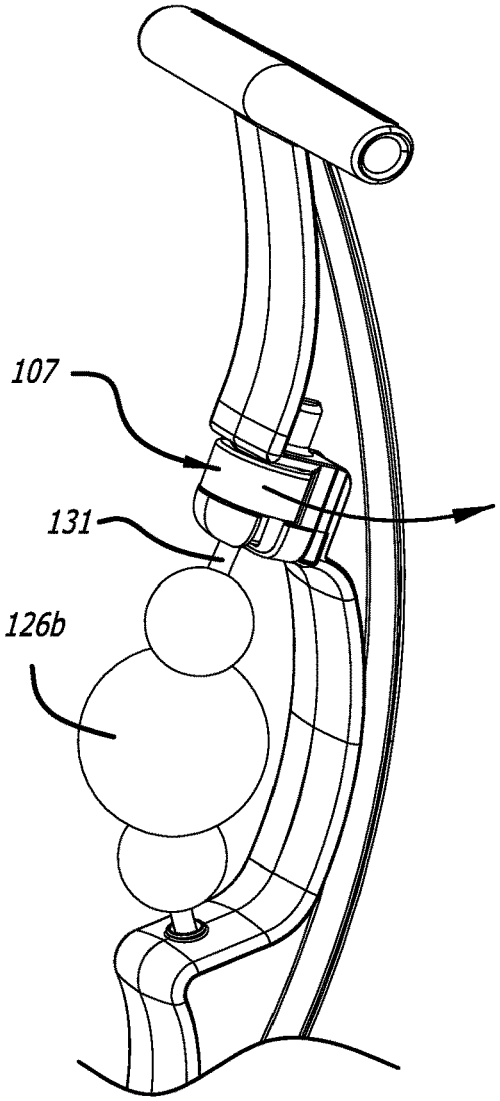
FIG. 5 is a partial view of a latching mechanism of the second arm of the body massaging apparatus of FIG. 1 in a closed position.
Figure 6:
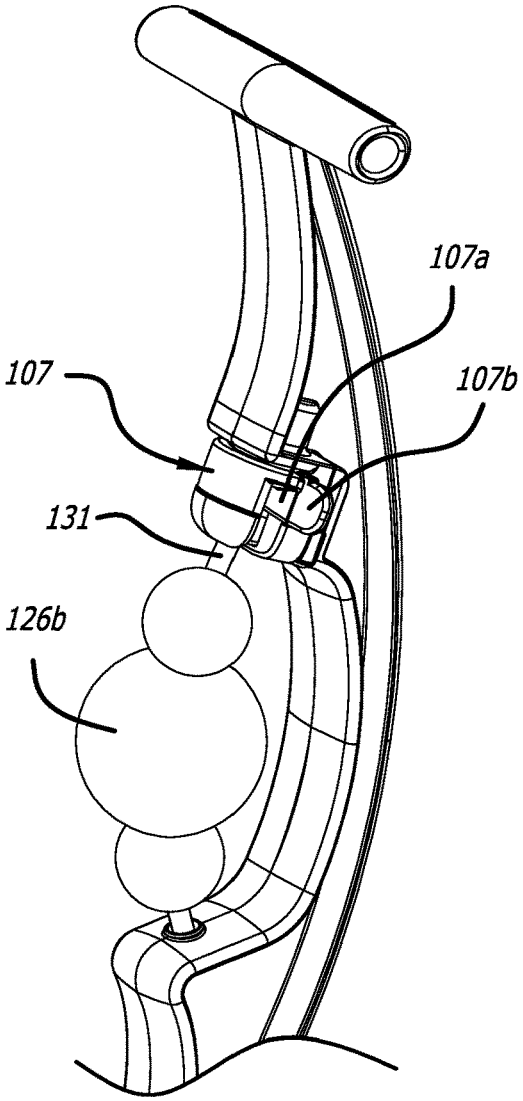
FIG. 6 is a partial view of the latching mechanism of the second arm of the body massaging apparatus of FIG. 1 in an open position.
Figure 7:
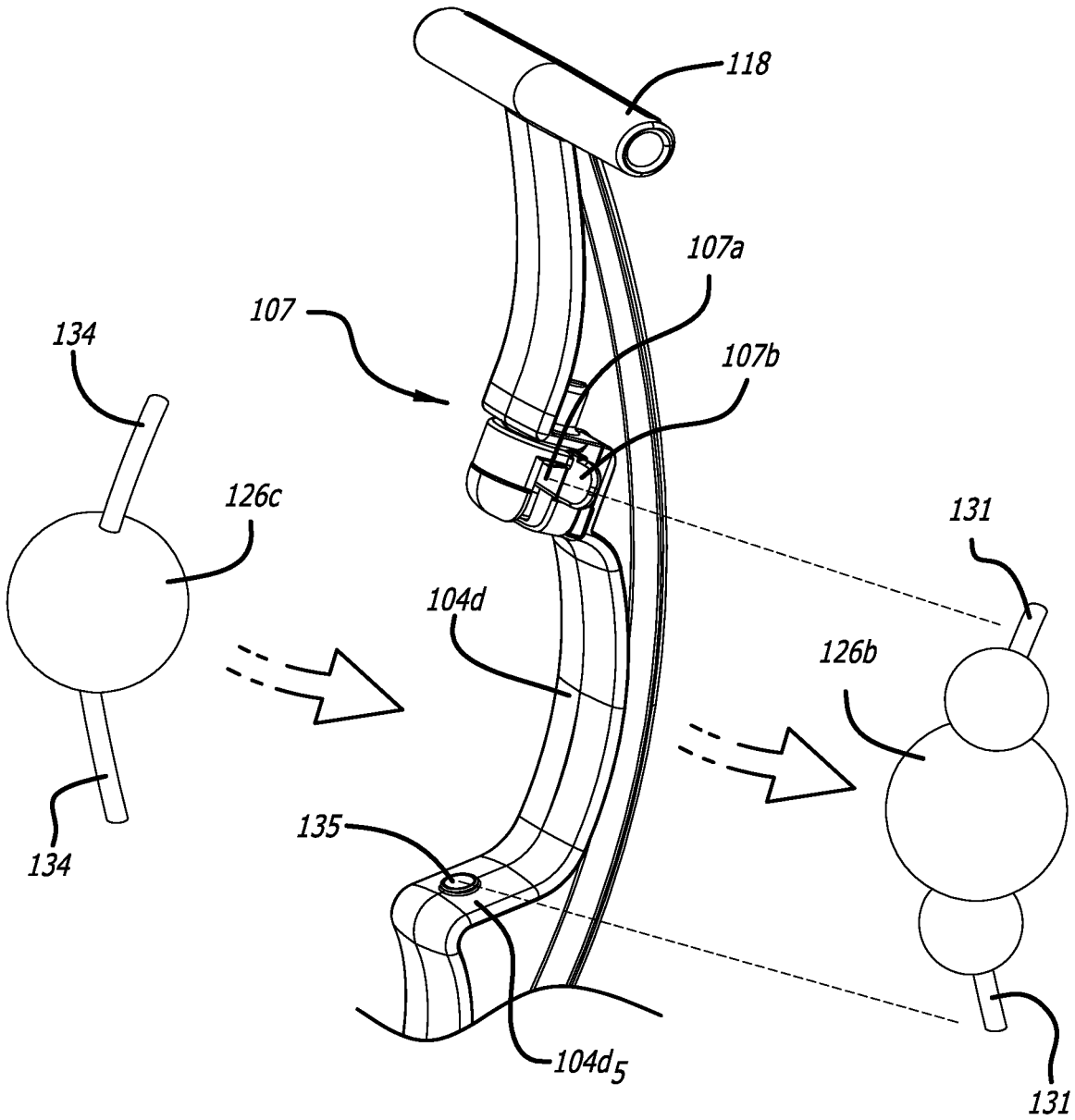
FIG. 7 is a partial view of the second arm of the body massaging apparatus of FIG. 1 with the latching mechanism is an open position for changing massaging members.
Figure 8:
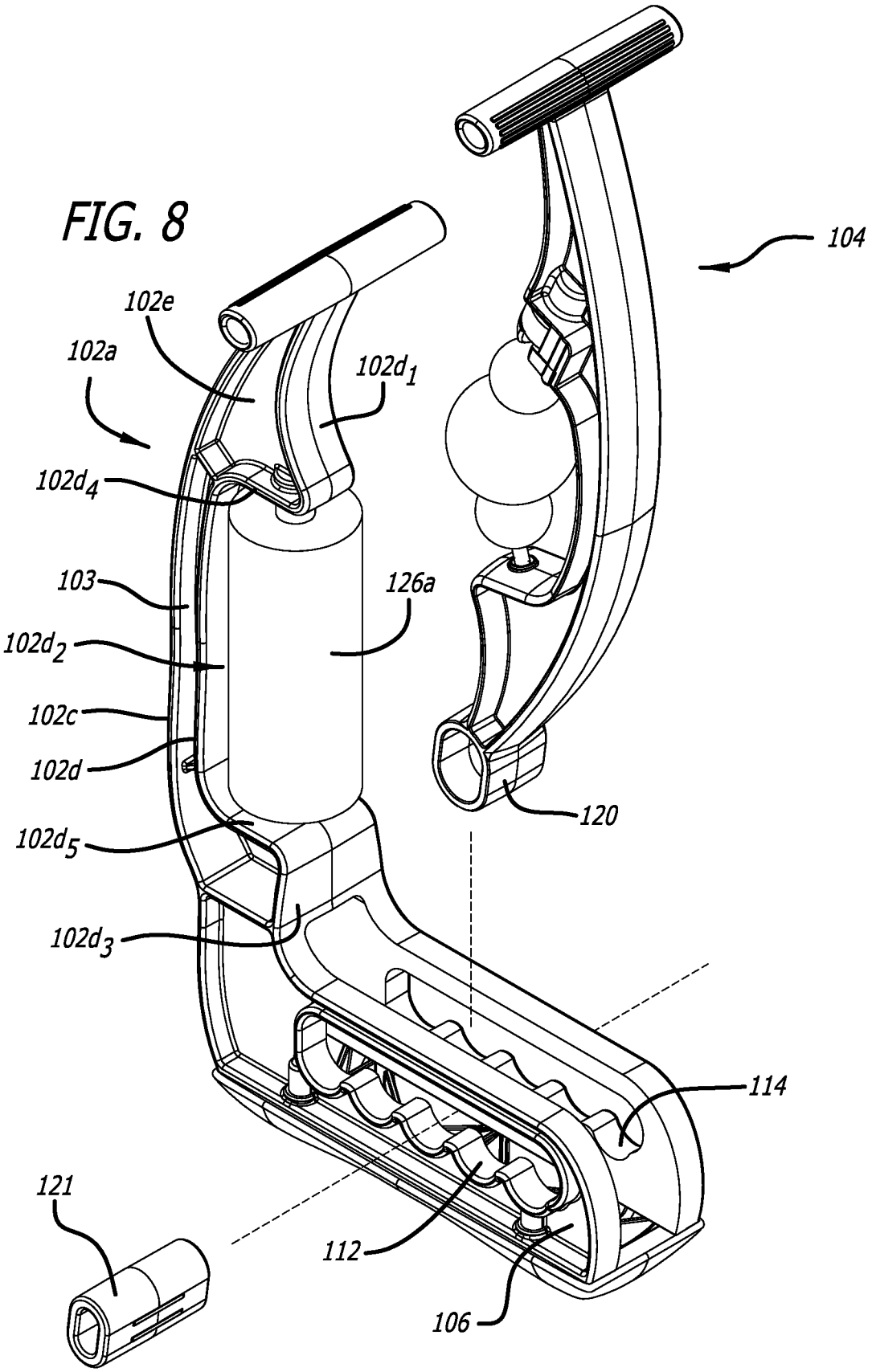
FIG. 8 shows the body massaging apparatus of FIG. 1 with the second arm removed.
Figure 9:
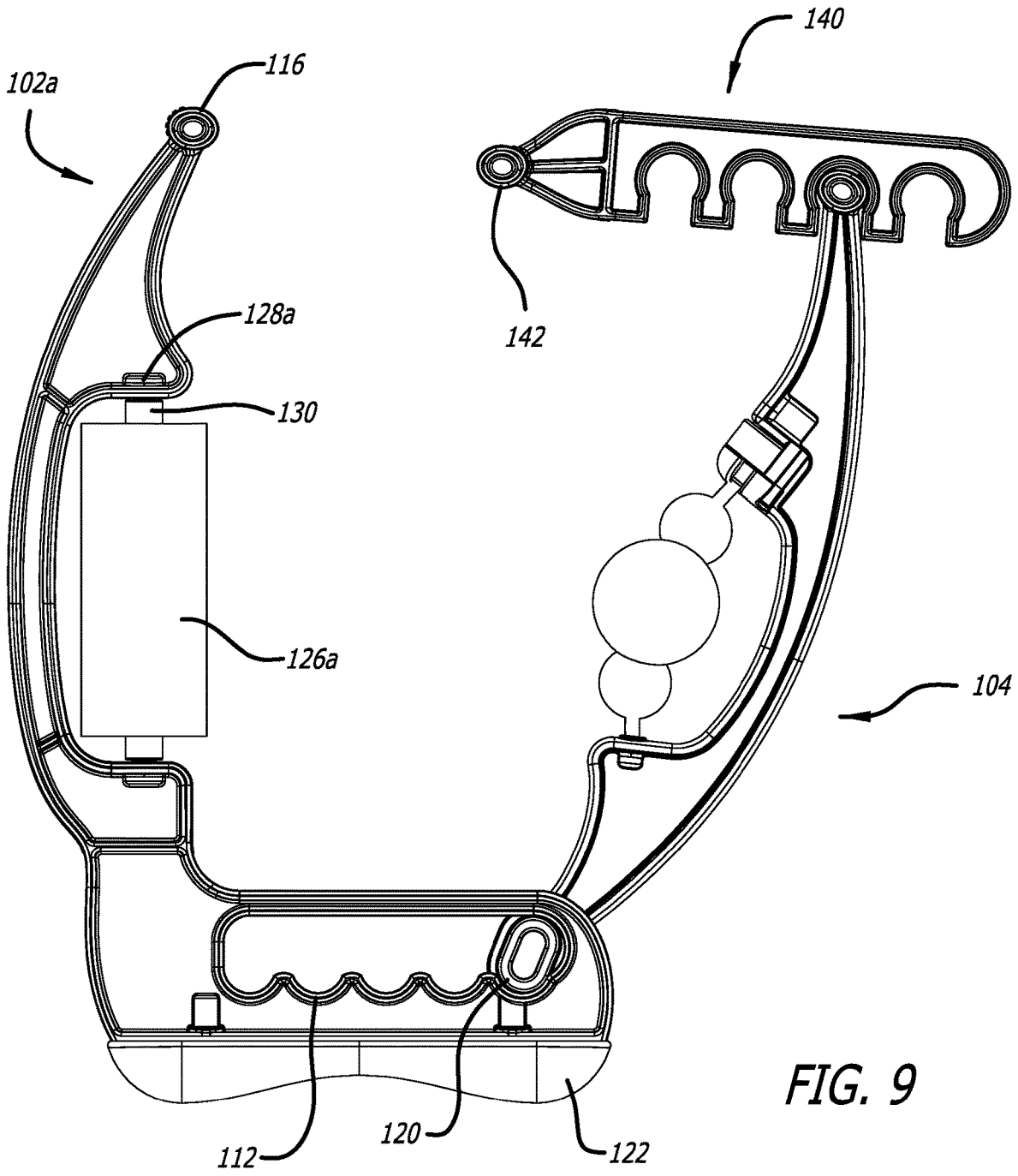
FIG. 9 is a side elevation view of an extension handle secured to the second arm of the body massaging apparatus of FIG. 1.
Figure 10:
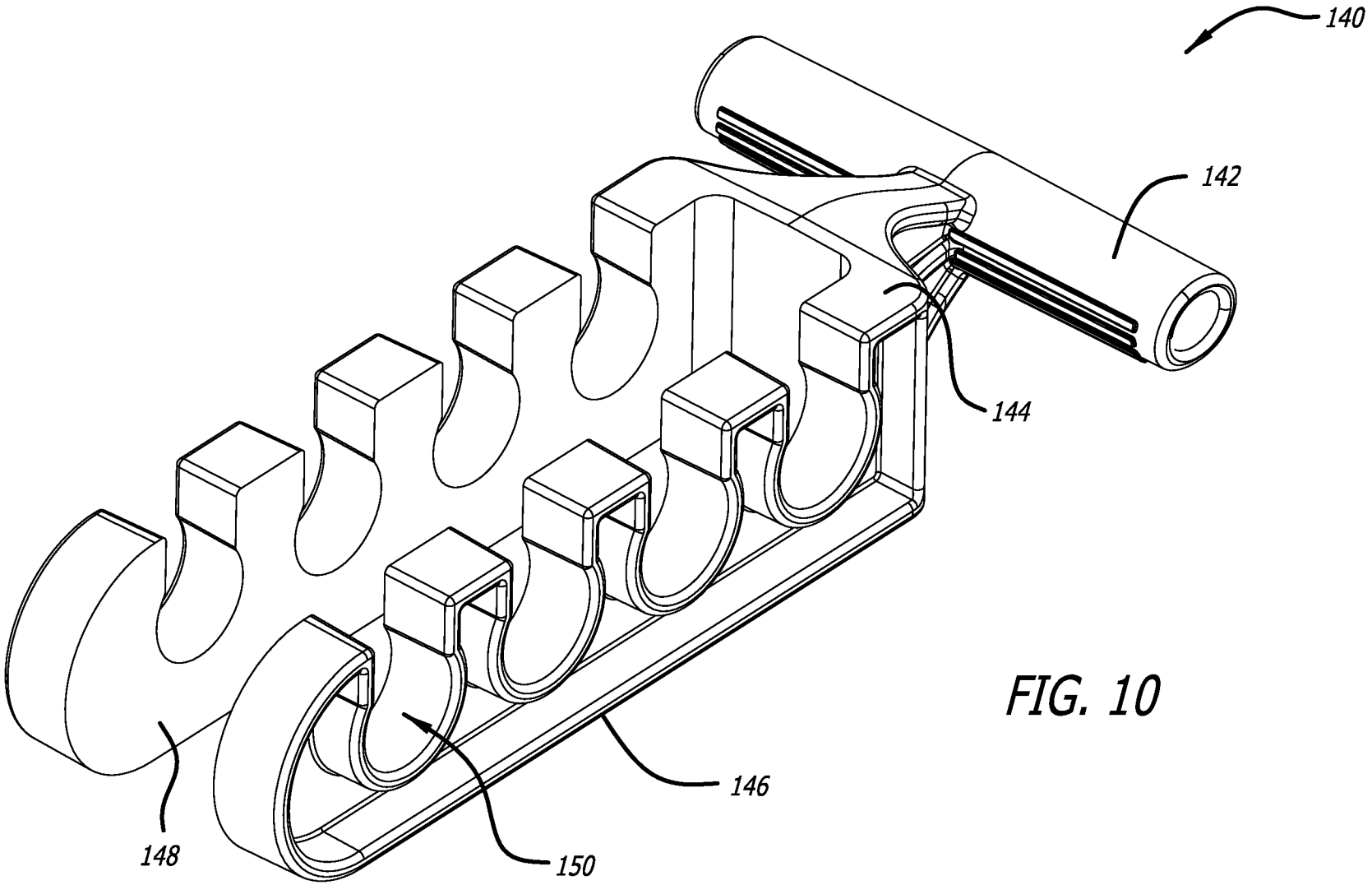
FIG. 10 is the extension handle used on the body massaging apparatus of FIG. 9.
Figure 11:
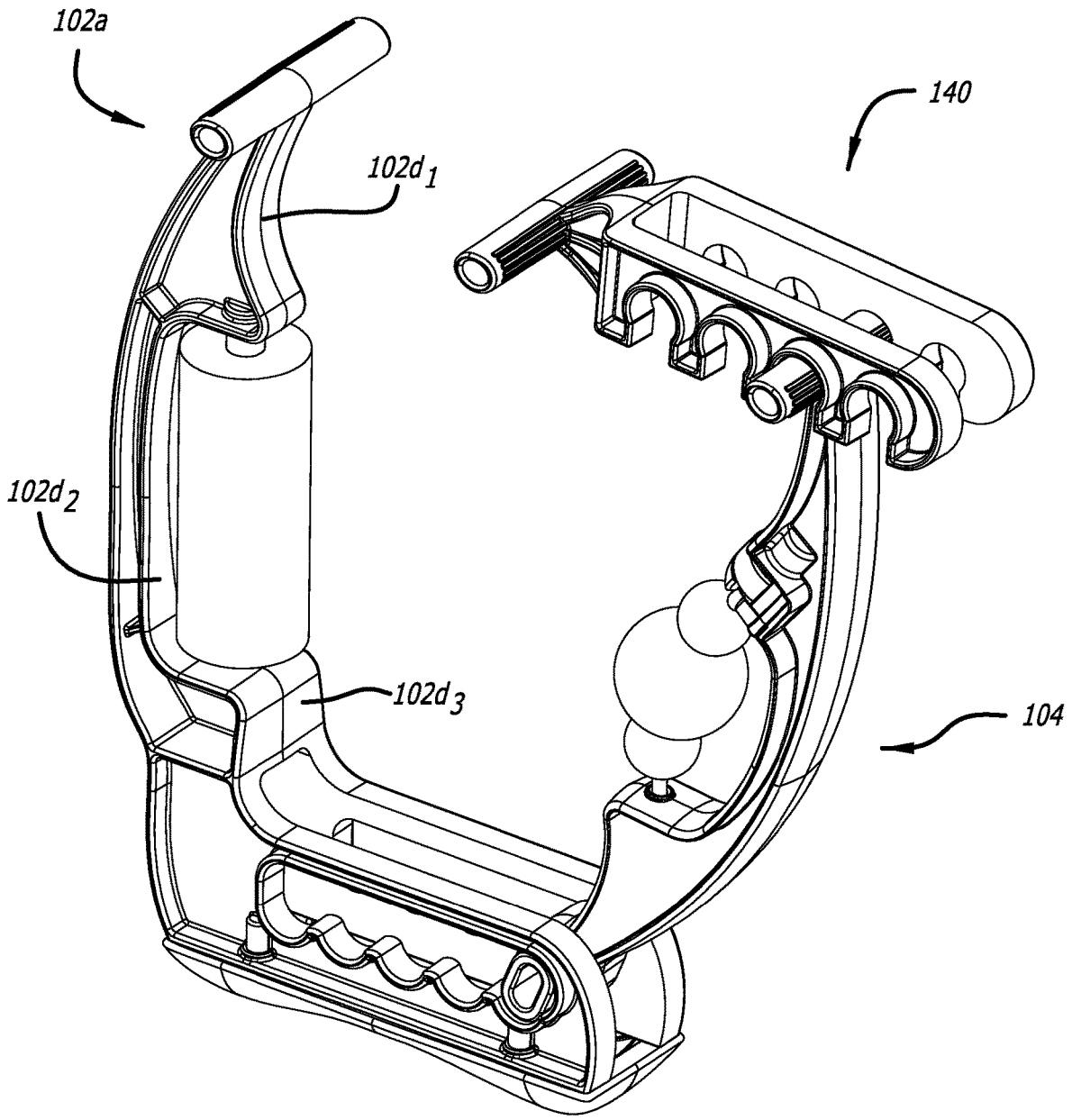
FIG. 11 is a front right perspective view of the extension handle secured to the second arm of the body massaging apparatus of FIG. 1.
Figure 12:
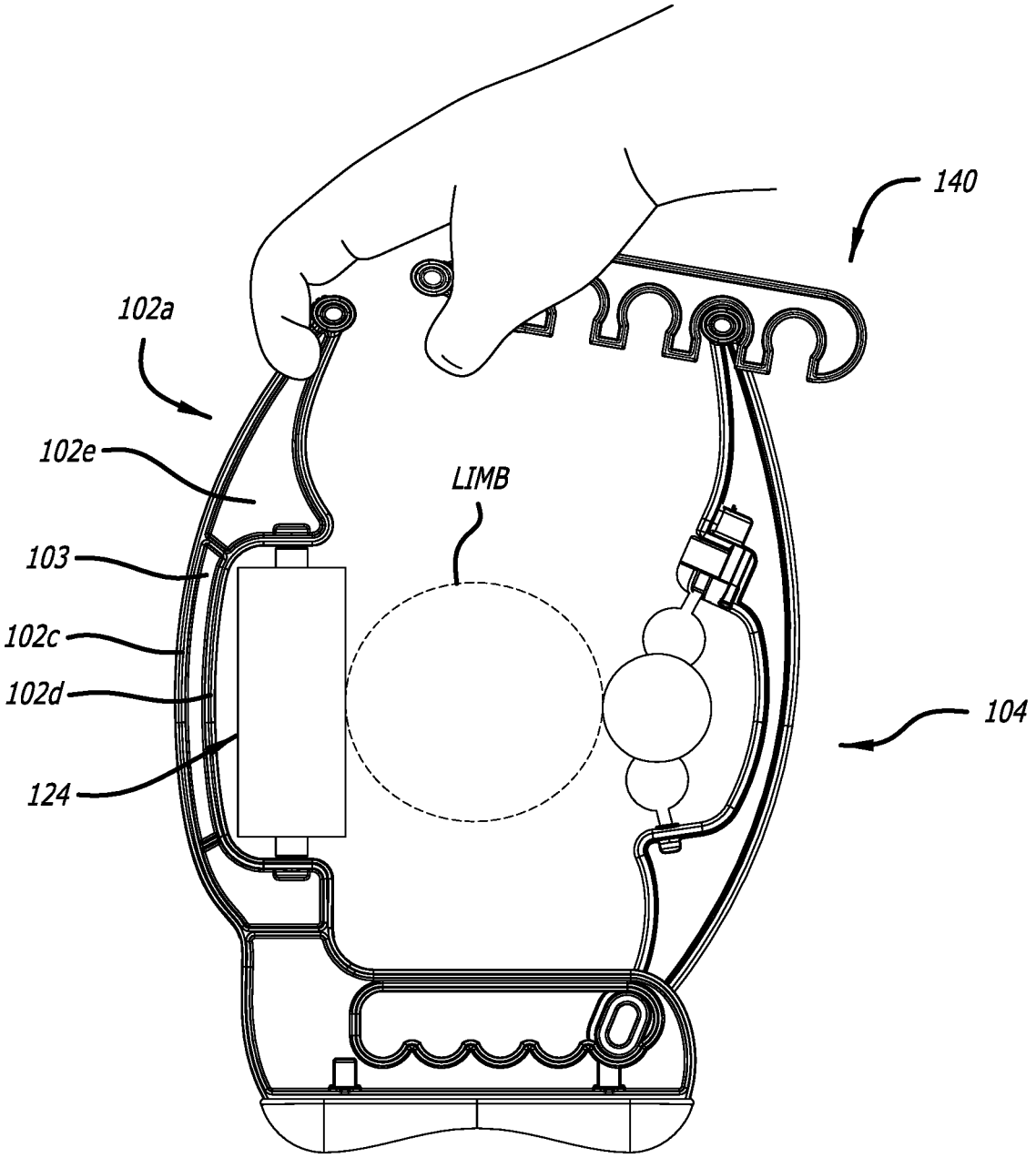
FIG. 12 is a side elevation view of the body massaging apparatus of FIG. 11 being used on the limb of a user.

FIG. 1 is a first side view of a massaging apparatus. FIG. 2 is back left side perspective view of the body massaging apparatus of FIG. 1. FIG. 3 is back right side perspective view of the body massaging apparatus of FIG. 1. FIG. 4 is a partial close up view of first and second arms of the body massaging apparatus of FIG. 1. FIG. 5 is a partial view of a latching mechanism of the second arm of the body massaging apparatus of FIG. 1 in a closed position. FIG. 6 is a partial view of the latching mechanism of the second arm of the body massaging apparatus of FIG. 1 in an open position. FIG. 7 is a partial view of the second arm of the body massaging apparatus of FIG. 1 with the latching mechanism is an open position for changing massaging members. FIG. 8 shows the body massaging apparatus of FIG. 1 with the second arm removed. FIG. 9 is a side elevation view of an extension handle secured to the second arm of the body massaging apparatus of FIG. 1. FIG. 10 is the extension handle used on the body massaging apparatus of FIG. 9. FIG. 11 is a front right perspective view of the extension handle secured to the second arm of the body massaging apparatus of FIG. 1. FIG. 12 is a side elevation view of the body massaging apparatus of FIG. 11 being used on the limb of a user. The following discussion refers interchangeably to FIGS. 1-12.

As shown, the body massaging apparatus 100 may include a first arm 102, having a first arm upper end 102*a* and a first arm lower end 102*b*, and a second arm 104, having a second arm upper end 104*a* and a second arm lower end 104*b*. The first and second arms 102, 104 may be maintained in an adjustable relationship to each other. That is, the first and second arms 102, 104 may be set by the user at various discrete distances from each other to create a desired gap or space 101 between the first and second arms 102, 104 by moving or rotating one or both of the arms along an axis perpendicular to mounting axes of the massaging member. The size of the gap 101 is adjustable so that the gap can be adapted to receive and accommodate a body part to which the body massaging apparatus 100 is being used on. (See FIG. 12) Large gaps 101 being necessary to accommodate larger body parts, such as legs and arms, with smaller gaps 101 being necessary to accommodate smaller body parts, such as fingers.

A first handle 116 may be integrally connected to, and extend perpendicularly outward from, the first arm upper end 102*a* and a second handle 118 may be integrally connected to, and extend perpendicularly outward from, the second arm upper end 104*a*. Although the first and second handles 116, 118 are shown as having elongated tubular configurations, this is by way of example only and the first and second handles 116, 118 may utilize any configuration known in the art and may be solid instead of tubular.

The first arm lower end 102*b* may include a first elongated member 106 (See FIG. 1) integrally connected to, and extending perpendicularly outward from, a first side of the first arm 102 and a second elongated member 108 (See FIG. 2) may be integrally connected to, and extending perpendicularly outward, from a second side of the first arm 102. The first elongated member 106 may be separated from the second elongated member 108 forming a space or channel 109 adapted or configured to receive the second arm lower end 104*b* of the second arm 104. Both the first and second elongated members 106, 108 have closed end preventing the second arm 104 from sliding out of the first and second elongated members 106, 108.

Each of the first and second elongated members 106, 108 may have a generally rectangular configuration and include a slotted guideway 112 and 114, respectively, (See FIGS. 1 and 2) having corresponding discrete pairs of depressions along its lower surface and a flat surface separated by a distance allowance for insertion of the securing member 120. The upper surface is flat. The depressions may be adapted or configured to receive and engage with a securing member 120 located on the second arm lower end 104*b* allowing the second arm 104 to rotate relative to the first arm and along an axis perpendicular to the mounting axes of massaging members, described below.

The securing (or massaging) member 120 may be integrally connected to the second arm lower end 104*b* and adapted to be received within the slotted guideways 112, 114 each having a plurality of depressions on the lower surface. For example, the securing (or massaging) member 120 may be inserted into the slotted guideway 112, 114 of the first arm 102 and then aligned with one of the pairs of depressions (that is a depression from each of the slotted guideways 112, 114) to achieve a desired relative positioning of the first and second arms 102, 104. Next, the second arm 104 may be pivoted into a substantially parallel orientation to the first arm 102, causing the securing member 120 to engage with a pair of depressions and maintain the spacing of the arms 102, 104 as desired. As described above, a user may place a body part, such as a limb, between the two arms of the apparatus (See FIG. 12) to be acted upon by massaging members 126*a*, 126*b* secured to each of the arms 102, 104, whereby the body part is adjustably clamped between the pair of massaging members 126*a*, 126*b* and massaged by translating and rotating movements of the body part along an axis perpendicular to the mounting axes of the massaging members 126*a*, 126*b*.

According to one aspect, a base 122 may be integrally connected to the bottom surfaces of the slotted guideways 112 and 114 at the first arm lower end 102*b*. The base 122 may have an arcuate shape according to one example. The base 122 may be made of, or covered with, a high-stick, non-skid material, so that the body massaging apparatus 100, when placed on a surface, remains substantially in place during use. The base 122 of the body massaging apparatus 100 may also be used as a handle to support the position and movement of the body massaging apparatus 100, for example, when the body massaging apparatus 100 is used on a leg (rather than moving the leg through a stationary device, the body massaging apparatus 100 is moved over the stationary leg). In this example, the user's other hand grasps the first and second handles 116, 118 to regulate pressure being applied to the leg.

The first arm 102 may have an outer surface 102*c* and an inner surface 102*d* separated by and integrally connected, to an inner wall 102*e* of the first arm 102. According to one aspect, the thickness of the inner wall 102*e* may be smaller than the widths of the outer and inner surfaces 102*c*, 102*d* forming a ridge or lip 103 allowing for a user to easily grasp the first arm 102. The inner surface 102*d* may have a first opening or cavity 124 adapted or configured to receive a first securing (or massaging member) 126*a*. According to one example, the outer surface 102*c* of the first arm 102 may have a generally continuous arcuate shape while the inner surface 102*d* may include an upper portion $\mathbf{102}d_1$, a medial portion $\mathbf{102}d_2$ and a lower portion $\mathbf{102}d_3$ where the medial portion $\mathbf{102}d_2$ is integrally connected between the upper portion $\mathbf{102}d_1$ and the lower portion $\mathbf{102}d_3$. The medial portion $\mathbf{102}d_2$ may be connected to the upper portion $\mathbf{102}d_1$ by an upper edge portion $\mathbf{102}d_4$ and the lower portion $\mathbf{102}d_3$ by a lower edge portion. According to one example, the upper edge portion $\mathbf{102}d_4$ and the lower edge portion $\mathbf{102}d_5$ may extend substantially perpendicularly outward from the upper and lower ends of the medial portion $\mathbf{102}d_2$ creating or forming the first cavity 124 in the first arm 102. Although all portions $\mathbf{102}d_1$-$\mathbf{102}d_3$ are shown having an arcuate shape, this is by way of example only. The upper portion $\mathbf{102}d_1$ and the lower portion $\mathbf{102}d_3$ are located within a first vertical plane and the medial portion $\mathbf{102}d_2$ is located within a second vertical plane where the first vertical plane is different than the second vertical plane.

According to one aspect, the upper edge portion $\mathbf{102}d_4$ of the inner surface 102*d* of the first arm 102 may include a first aperture 128*a* and the lower edge portion $\mathbf{102}d_5$ of the inner surface 102*d* of the first arm 102 may include a second aperture 128*b*. The first massaging member 126*a* may include a roller, for example, secured or mounted to a substantially rigid shaft 130 adapted or configured to be received within the first and second apertures 128*a*, 128*b* securing the first massaging member 126*a* to the first arm 102. Alternatively, the shaft 130 may be made from any flexible material known in the art. The first massaging member 126*a* may be rotatable by the roller rotating around the shaft 130 or the shaft 130 being rotatable when secured within the first and second apertures 128*a*, 128*b*. The roller may be formed of any type of material known in the art such as foam, rubber or plastic.

The second arm 104 may have an outer surface 104*c* and an inner surface 104*d* separated by and integrally connected to an inner wall 104*e*. According to one aspect, the thickness of the inner wall 104*e* may be smaller than the widths of the outer and inner surfaces 104*c*, 104*d* forming a ridge or lip 105 allowing for a user to easily grasp the second arm 104. The inner surface 104*d* of the second arm may have a second opening or cavity 132 adapted or configured to receive a second massaging member 126*b*. According to one example, the outer surface 104*c* may have a generally continuous arcuate shape while the inner surface 104*d* may include an upper portion 104$d_1$, a medial portion 104$d_2$ and a lower portion 104$d_3$ where the medial portion 104$d_2$ is integrally connected between the upper portion 104$d_1$ and the lower portion 104$d_3$. The medial portion 104$d_2$ may be connected to the upper portion 104$d_1$ by a latching mechanism 107. The latching mechanism 107 may include a rotatable member having a cavity 107*a* adapted to removable receive a first end of a shaft 131 of a second massaging apparatus 126*b*, the second end of the shaft 131 may be removable received in and opening 135 in a lower edge portion 104$d_5$ of the second arm 104 as described in more detail below. The latching mechanism 107 may further include a tab 107*b* extending outwardly from the rotatable member. The tab 107*b* allows for a user to easily rotate the rotatable member to expose the cavity 107*a* so the user can pull out the shaft 131 of the second massaging member 126 and replace with a different type of massaging member, such as massaging member 126*c* in FIG. 7, allowing the user to change the massaging member based on the user's needs. Each massaging member has a shaft, like the shaft 131 in the massaging member 126*b*, which can be inserted into the opening 135 and the cavity of the latching mechanism 107. Once in place, the tab 107*b* is rotated locating the massaging member into the arm. The shaft 131 may be rigid or alternatively, the shaft 131 may be flexible.

According to one example, an upper edge portion 104$d_4$ and the lower edge portion 104$d_5$ may extend substantially perpendicularly outward from the medial portion 104$d_2$ creating or forming the second cavity 130 in the second arm 104. Although all portions 104$d_1$-104$d_3$ are shown having an arcuate shape, this is by way of example only and may have any other shape. The upper portion 104$d_1$ and the lower portion 104$d_3$ are located within a first vertical plane and the medial portion 104$d_2$ is located within a second vertical plane where the first vertical plane is different than the second vertical plane. The latching mechanism 107 may be integrally connected to and located above the upper edge portion 104$d_4$.

According to one aspect, the inner surface 104*d* of the second arm 104 may include a an aperture 136 adapted to receive the second end of the shaft 131 while the first end of the shaft 131 may be received within the cavity 107*a* of the latching mechanism 107 as described above. The rotatable member of the latching member 107 may further be rotated using the tab 107*b* providing the latching member 107 to be operable between an open position and a closed position. When in the open position, the cavity 107*b* is exposed allowing the first end of the shaft 131 to be pulled outwardly and the second end of the shaft to be pulled upwardly out of the aperture 136 allowing the second massing member to be removed and replaced. Although the latching member 107 is illustrated on the second arm 104, this is by way of example only and the latching member 107 may be located on the first arm 102 or the first and second arm may include latching members allowing for both massaging members to be removed and replaced or exchanged. When the first and second arms 102, 104 of the body massaging apparatus 100 are used together, a user may place or insert a body part between them allowing the user to perform various different desired therapy techniques known in the art. (See FIG. 7)

Turning to FIG. 7, a partial view of the second arm of the body massaging apparatus of FIG. 1 with the latching mechanism in an open position for changing massaging members is shown. As discussed above, the latching mechanism 107 has a rotatable member with a cavity 107*b* and a tab 107*a* extending outwardly from the rotatable member, the latching member 107 is operable between an open position and a closed position. In FIG. 7 the latching member 107 is shown in an open position. As can be seen in FIG. 7, the second massaging member 126*a* has been removed. The first end of the shaft 131 has been removed from the cavity 107*b* allowing the second end of the shaft 131 to be pulled upward out of the opening 135 in the lower edge portion 104$d_5$ of the second arm 104. While the latching member 107 is in the open position a lower end of the shaft 134 of a third massaging member 126*c* may be inserted into the opening 135 in the lower edge portion 104$d_5$ of the second arm 104 and an upper end of the shaft 134 may be placed in the cavity 107*b* and the tab 107*a* rotated to the left securing the third massaging member 126*c* into the body massing apparatus. This allows a user to change the massaging member to adapt to the needs of the user.

Second Arm Removable

FIG. 8 shows the body massaging apparatus of FIG. 1 with the second arm removed. As discussed above, each of the first and second elongated members 106, 108 may have a generally rectangular configuration and include slotted guideways 112 and 114, respectively, (See FIGS. 1 and 2) having corresponding discrete pairs of depressions or openings along its lower surface. The depressions may be adapted or configured to receive and engage with a securing member 120 located on the second arm lower end 104*b* allowing the second arm 104 to rotate relative to the first arm and along an axis perpendicular to the mounting axes of massaging members, described below. The securing member 120 may be hollow and adapted to receive a stopper 121 which is used to prevent the second arm 104 from being removed from the slotted gateway 112, 114 of the first arm. To remove the second arm from the slotted gateway, the securing member 120 is slid to the outermost pairs of depressions which are larger than the other depressions and have a more oval configuration. When the securing member 120 is in the last pair of depressions (See FIG. 9), the second arm may be rotate into a position that fits within the oval and allows the second arm 104 to rotate downward. Once rotated downward, the stopper 131 may be removed (or slid out from the securing member 120) allowing the second arm to be separated from the slotted gateway. The stopper 131 locks the securing member 120 into the slotted gateway.

Massaging Apparatus—Extension Handle

FIG. 9 is a side elevation view of an extension handle secured to the second arm of the body massaging apparatus of FIG. 1. FIG. 10 is the extension handle used on the body massaging apparatus of FIG. 9. FIG. 11 is a front right perspective view of the extension handle secured to the second arm of the body massaging apparatus of FIG. 1. FIG. 12 is a side elevation view of the body massaging apparatus of FIG. 11 being used on the limb of a user. The following discussion refers interchangeably to FIGS. 9-12.

An extension handle may be utilized to allow the user to easily grab the first and second handle 116 and 118 with a single hand (See FIG. 12). As described above, the body massaging apparatus 100 may include a first arm 102, having a first arm upper end 102*a* and a first arm lower end

102*b*, and a second arm 104, having a second arm upper end 104*a* and a second arm lower end 104*b*. The first and second arms 102, 104 may be maintained in an adjustable relationship to each other. That is, the first and second arms 102, 104 may be set by the user at various discrete distances from each other to create a desired gap or space 101 between the first and second arms 102, 104 by moving or rotating one or both of the arms along an axis perpendicular to mounting axes of the massaging member. The size of the gap 101 is adjustable so that the gap can be adapted to receive and accommodate a body part to which the body massaging apparatus 100 is being used on. (See FIG. 12) Large gaps 101 being necessary to accommodate larger body parts or limbs, such as arms, with smaller gaps 101 being necessary to accommodate smaller body parts, such as legs.

As can be seen in FIGS. 9 and 11, an extension handle 140 may be utilized with the body massaging apparatus described in the present disclosure. The extension handle 140 may be detachably secured to the first or second handles 116, 118 of the first and second arms 102, 104 for easily allowing a user to extend the opening while still being able to hold the massaging apparatus in an open configuration with a single hand. (See FIG. 12)

The extension handle 140 may comprise an elongated member 142 connected to a body member 144. A longitudinal first leg 146 and a longitudinal second leg 148 extend perpendicularly outward from the body member. The longitudinal first leg 146 is separate from and parallel to the longitudinal second leg 148. Each of the longitudinal first leg 146 and the longitudinal second leg 148 includes a plurality of openings or recesses 150 for attaching to the first and/or second handles 116, 118. The shape of the openings 150 are configured to fit over the first and/or second handles 116, 118 and the size of the openings is adapted to fit over a handle and be held in place. Although four (4) openings are shown in each of the longitudinal first leg 146 and the longitudinal second leg 148, this is by way of example only and the first and second leg 146, 148 may include more than four (4) openings 150 or less than four (4) openings 150. The plurality of openings 150 allow the user to place the handle into the appropriate opening to allow for the user to grab both handles despite the size of the limb placed between the two arms. FIG. 12 show a limb located between the two messaging members and the handle on the second arm located in a second opening which allows the extension handle to extend out far enough so the user can grasp both handles with one hand. Alternatively, the extension handle 140 may include only a single longitudinal leg or the extension handle may include more than two longitudinal legs.

While certain exemplary embodiments have been described and shown in the accompanying drawings, it is to be understood that such embodiments are merely illustrative of and not restrictive on the broad invention, and that this invention is not be limited to the specific constructions and arrangements shown and described, since various other modifications may occur to those ordinarily skilled in the art.

The invention claimed is:

1. A body massaging apparatus, comprising:

a first arm, having a first arm upper end and a first arm lower end, the first arm lower end having a pair of elongated members extending outward therefrom and separated by a channel, each of the elongated members in the pair of elongated members having a slotted guideway;

a second arm having a second arm upper end and a second arm lower end, the second arm lower end having a securing member adapted to be received in a pair of depressions formed in the slotted guideway of the each of the elongated members in the pair of elongated members, where the second arm is rotatable in relation to the first arm;

a first massaging member secured within a medial section of the first arm;

a second massaging member secured within a medial section of the second arm; and a latching mechanism having a rotatable member with a cavity and a tab extending outwardly from the rotatable member, the latching member operable between an open position and a closed position;

wherein when in the open position, a shaft of the second massaging member is removable from the second arm.

2. The body massaging apparatus of claim 1, further comprising:

a first handle integrally connected to, and extending perpendicularly outward from, the first arm upper end; and a second handle integrally connected to, and extending perpendicularly outward from, the second arm upper end.

3. The body massaging apparatus of claim 2, further comprising an extension handle adapted for securing to the first and/or second longitudinal handles.

4. The body massaging apparatus of claim 3, wherein the extension handle comprises:

an elongated member;

a body member, the body member integrally connected to the elongated member;

a longitudinal first leg extending perpendicularly outward from the body member;

a longitudinal second leg extending perpendicularly outward from the body member, the longitudinal first leg is parallel to the longitudinal second leg;

wherein each of the of the longitudinal first and second legs comprises a plurality of openings adapted to fit over the first and/or second handles.

5. The body massaging apparatus of claim 1, wherein the slotted guideway includes a lower surface, having a plurality of depressions, and an upper surface where the upper and lower surfaces are separated by a distance.

6. The body massaging apparatus of claim 5, wherein the distance is adapted to receive the securing member.

7. The body massaging apparatus of claim 6, wherein the securing member is hollow.

8. The body massaging apparatus of claim 7, wherein the slotted guideway a last opening in the slotted gateway is oval shaped and larger than the remaining openings in the slotted gateway.

9. The body massaging apparatus of claim 8, wherein the oval shaped opening allows the second arm to be rotated downward and slid out of the slotted gateway.

10. The body massaging apparatus of claim 9, further comprising a stopper adapted to be received into the hollow securing member for securing the second arm in the body massaging apparatus.

11. The body massaging apparatus of claim 1, wherein the second arm comprises:

an outer surface;

an inner surface having separated by and integrally connected to an inner wall, the inner surface having a second massaging member cavity adapted to receive the second massaging member.

12. The body massaging apparatus of claim 11, wherein the outer surface has a continuous arcuate shape; and wherein the inner surface includes an upper portion, a medial portion and a lower portion where the medial portion is integrally connected between the upper portion and the lower portion.

13. The body massaging apparatus of claim of claim 12, wherein the medial portion is connected to the upper portion by the latching mechanism.

14. The body massaging apparatus of claim 13, wherein the second massaging member includes an elongated shaft extending through the second massaging apparatus, the shaft having an upper end and an opposing lower end.

15. The body massaging apparatus of claim 14, wherein the lower end of the shaft is adapted to be received in a shaft opening located in a lower portion of the second arm.

16. The body massaging apparatus of claim 15, wherein the upper end of the shaft is adapted to be received in the cavity of the latching mechanism.

17. The body massaging apparatus of claim 16, wherein the tab on the latching mechanism is rotated covering the cavity and locking the upper end of the shaft in the latching mechanism.

18. The body massaging apparatus of claim 17, wherein the tab extends outwardly from the latching mechanism.

19. The body massaging apparatus of claim 18, wherein rotating the tab to expose the cavity allows the second massaging member to be replaced with a different massaging member.

* * * * *